US005102064A

United States Patent [19]

Daly

[11] Patent Number: 5,102,064

[45] Date of Patent: Apr. 7, 1992

[54] MISSILE GUIDANCE SYSTEMS

[75] Inventor: Martin A. K. Daly, Harpenden, England

[73] Assignee: British Aerospace Public Limited Company, London, England

[21] Appl. No.: 89,139

[22] Filed: Nov. 12, 1970

[51] Int. Cl.[5] ..... F41G 7/30; F41G 7/32

[52] U.S. Cl. ..... 244/3.11; 244/3.12

[58] Field of Search ..... 244/3.12, 3.13, 3.14, 244/3.11

[56] References Cited

U.S. PATENT DOCUMENTS 3,233,847 2/1966 Girsberger ..... 244/3.12

3,406,402 10/1968 Stauff et al. ..... 244/3.14

*Primary Examiner*—Charles T. Jordan

*Attorney, Agent, or Firm*—Cushman, Darby & Cushman

[57] ABSTRACT

A guidance system for controlling the flight of a guided missile onto a target, comprising an optical sight and a tracker mounted with their optical axes approximately in alignment in a common housing which is pivotable for aiming the sight at a target. The housing also carries a missile firing button and a manually-operable joystick for generating primary direction control signals for controlling the missile. The tracker produces automatically secondary control signals representative of the displacement of the missile in flight from the axis of the tracker. Transmitter means is provided in a separate housing for transmitting both primary and secondary control signals simultaneously to a receiver in the missile so that the flight of the missile is controlled by the combined primary and secondary signals.

3 Claims, 3 Drawing Sheets

MISSILE GUIDANCE SYSTEMS

This invention relates to missile guidance systems and is concerned with sighting and tracking apparatus for such systems.

In a known form of guidance system for controlling the flight of an anti-tank missile by manual means, an operator using a joystick on a ground controller controls the missile and guides it visually to the target. His commands are conveyed to the missile as electrical signals and the operator is able to compensate for movement of the target during flight of the missile by appropriate movement of the joystick. This form of control has various advantages, e.g. the apparatus required is relatively simple and light, and the accuracy of control does not greatly deteriorate at long ranges. However, there are certain disadvantages, e.g. the operator requires some time to gain control of the missile after launch and so accuracy of aim at very short ranges is poor. In training, operators require a considerable amount of practice in controlling actual missiles in flight and this tends to make the training of an operator expensive.

In another known form of guidance system where control of a missile is by semi-automatic means, an operator is provided with a combined sight tracker, the optical axes of which are collimated. In use, the operator sights a target and keeps his sight cross-wires aimed upon it. When a missile is launched, it will appear in the field of view of the tracker which may initially be comparatively wide compared with that of the sight. The missile, which may carry a flare to distinguish it from background illumination, produces an image focussed as a point of light on a photoelectric screen in the tracker, the displacement of which image from the electrical centre of the screen is used to provide a corresponding electrical signal for transmission to the missile. This signal controls the flight of the missile to tend to remove the displacement of the image from the screen centre, and thus maintains its trajectory along the tracker axis. Any tendency of the missile to drift off course is detected by the tracker and corrected by transmission of the appropriate electrical signal. The operator of a semi-automatic guidance system has to track the target with his sight all the time that a missile is in flight.

This form of control has several advantages. It is easier for an operator to use than a manual system as the operator merely maintains the cross-wires in his sight aimed upon the target, and he does not control the missile flight directly; gathering of a missile after launch is rapid as the response of the system is faster than can be achieved by an operator; the training of an operator requires the use of few practice missiles, since the operator can practice the maintenance of the sight cross-wires on a moving target without firing a missile. There are however certain disadvantages inherent in the semi-automatic system. Collimation errors can arise due for example to knocks or to solar heating effects, causing the sight and tracker to be mis-aligned. Accuracy of the system depends on how accurately the operator can keep his sight on the target, and this depends greatly on the design of the sight and tracker mounting; for instance, if they are mounted so as to be too loose, or too tight, movement will be uneven and it will be difficult to maintain accurate and smooth target following.

The object of the present invention is to provide a missile guidance system which combines the advantages of the manual and semi-automatic systems.

According to the present invention, a guidance system for a missile comprises an optical sight for aiming at a target, a manually-operable control for generating primary control signals in response to manipulation thereof by an operator, means for transmitting the primary control signals to a receiver in the missile to guide the missile in flight in accordance with the operator's manipulation of the manually-operable control, a tracker approximately aligned with the sight for tracking a missile in flight in the field of view of the tracker, the tracker being constructed and arranged to measure the displacement of the missile from the tracker axis and to generate secondary control signals representative of the said displacement, and means for transmitting the secondary control signals to a receiver in the missile for guiding the missile to reduce such displacement, whereby the missile is controlled in flight by the combined primary and secondary signals.

One embodiment of the invention will now be described by way of example with reference to the accompanying drawings in which.

Figure 1:
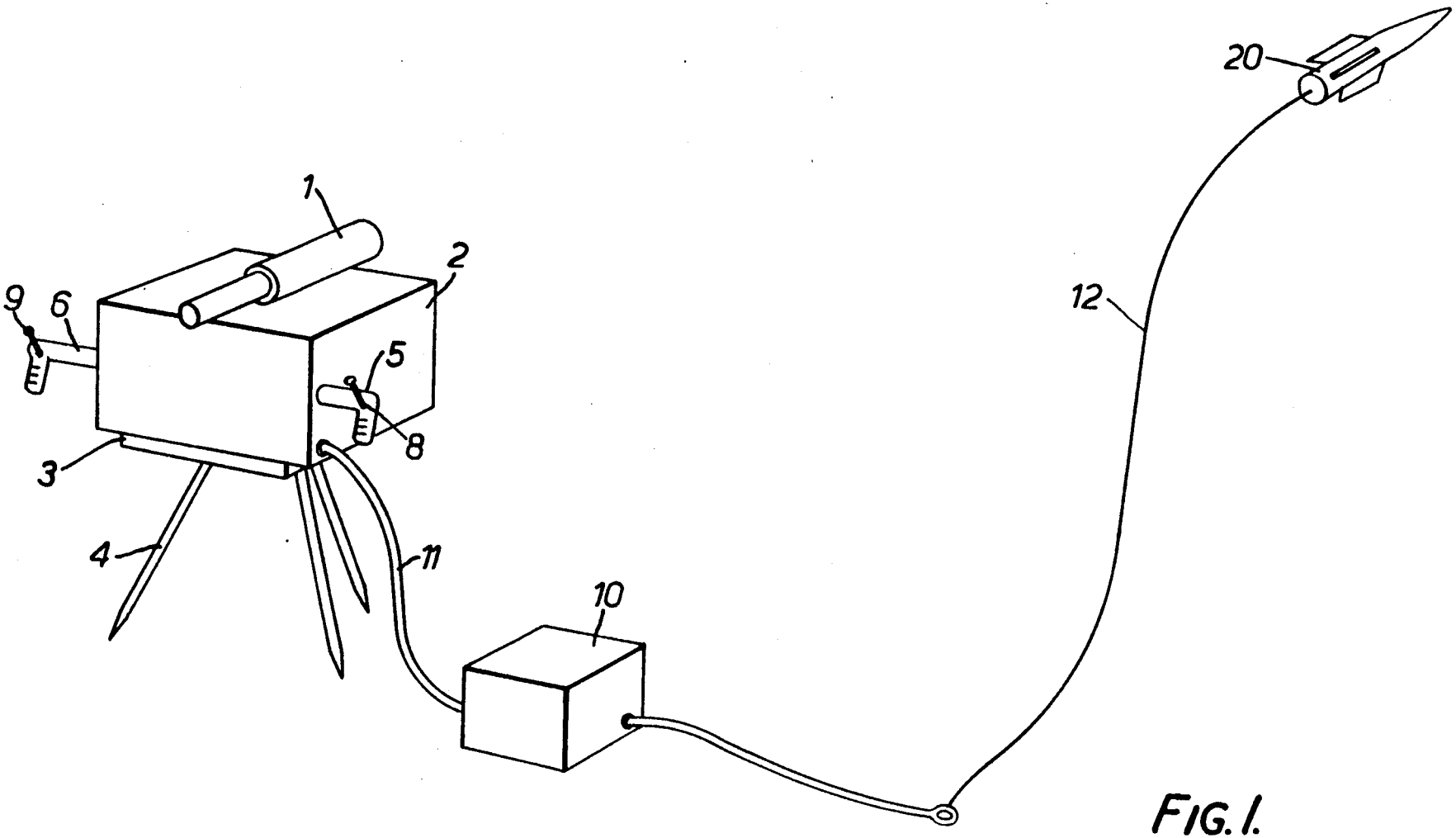
FIG. 1 is a general view of a combined manual and semi-automatic apparatus for controlling a missile.

Referring first to FIG. 1, a telescope sight 1 and a tracker 2 are fixed together and are rotatably supported by a pivotal mounting 3 upon a tripod 4. The telescope sight 1 and tracker 2 have their optical axes generally aligned. A pair of handlebars, 5, 6 are fixed to the tracker 2. One handlebar 5 includes a joystick 8 for operation by an operator to supply flight control signals to a missile 20. A firing button 9 is provided in the other handlebar 6 in order that the operator may fire a missile at the appropriate time. A separate controller in a housing 10 placed alongside the tripod 4 is electrically connected to the joystick control 98 and the tracker 2 by means of a cable 11. The joystick 8 is able to generate primary directional control signals for transmission to the missile 20 for controlling the flight of the missile, and these primary signals from joystick 8 are applied via cable 11 to an electrical shaping unit in the controller housing 10, which unit suitably modifies the signals and supplies them to a transmitter also positioned within the housing 10, for transmission via a trailing cable 12 to a receiver mounted in the missile 20. The primary signals received by the receiver are employed to control the operation of the actuators of the appropriate control surfaces of the missile 20. The tracker 2 is of the known kind having a photoelectric screen on which a real optical image of the missile exhaust, or of a flare carried by the missile, is focused, the tracker producing secondary control signals corresponding to the coordinates of the displacement of the missile image on the photoelectric screen from the electrical centre of the screen. A second shaping unit within the housing 10 receives the secondary electrical output signals via the cable 11 from the tracker 2, which signals are therefore representative of the direction and extent to which the missile is offset from the tracker axis. The second shaping unit suitable modifies the secondary signals and supplies them to the transmitter in the housing 10 for transmission via the cable 12 to the receiver in the missile for controlling the flight of the missile.

Figure 2:
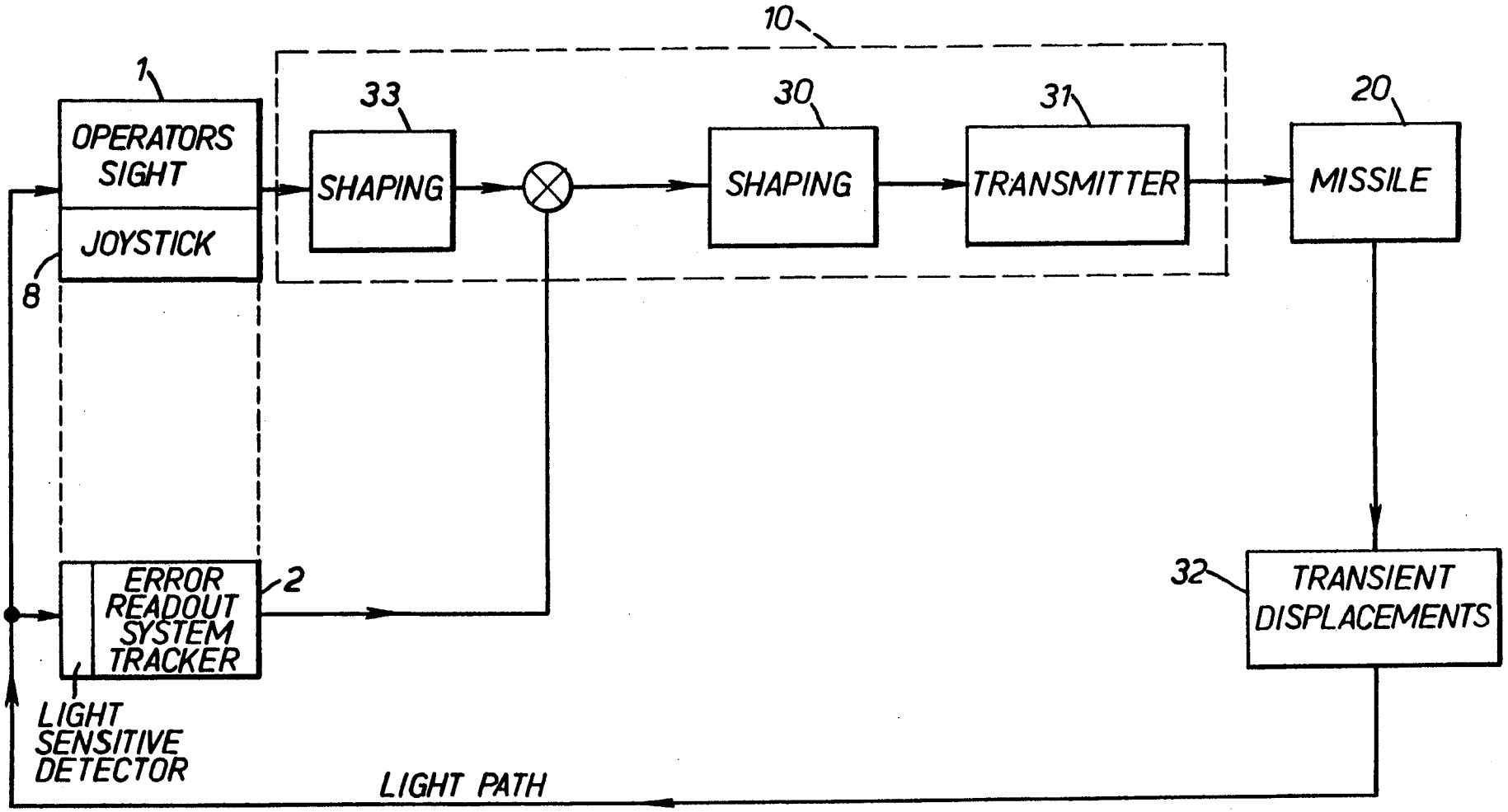
FIG. 2 is a block diagram of a control system for supplying a missile with control signals using the combined manual and semi-automatic apparatus of FIG. 1.

Referring now to FIG. 2, this shows diagrammatically the semi-automatic control system incorporated in the apparatus of FIG. 1. The operator aims the sighting device 1 at a target and thereby also directs the axis of the tracker 2 (which is coupled to the sighting device 1) approximately at the target. The output from the tracker 2 passes through the shaping unit 30 which modifies the output and supplies it to the missile 20 by means of the transmitter 31 and the trailing wire command link 12. Displacements 32 of the missile 20 in flight from the tracker axis are detected by the tracker 2 and compensating corrections are fed into the tracker output so that the missile 20 is controlled by the tracker to follow a straight course along the axis of the tracker.

Manual control comprises the sighting device 1 for viewing a target, the joystick 8 for supplying primary course-correcting signals to the missile 20, and the shaping unit 33 for modifying the primary signals from the joystick 8; the outputs of the shaping unit 33 are combined with those from the tracker 2, and are fed to the missile through the transmitter 31 and the trailing wire command link 12.

In use against a stationary target, the operator positions the tripod 4 so that the sighting telescope 1 is aimed at the target and therefore the tracker is approximately aligned upon the target. A missile is then launched by means of the missile firing button 9, whereupon the tracker automatically "gathers" the missile and controls it to fly along the tracker axis, transient displacements 32 of the missile being compensated for automatically and very rapidly by the tracker, and the operator not reacting to them.

The operator moves his joystick 8 so as to maintain the missile flight path along his sight line to the target, a single movement of the joystick resulting in the missile flying along a new sight line from the operator. The joystick 8 thus provides primary direction control of the missile as seen in the operator's sight 1, superimposed on the automatic control by the tracker. This is a much easier task than with other forms of control in which joystick movement results in missile side acceleration of velocity.

Figure 3:
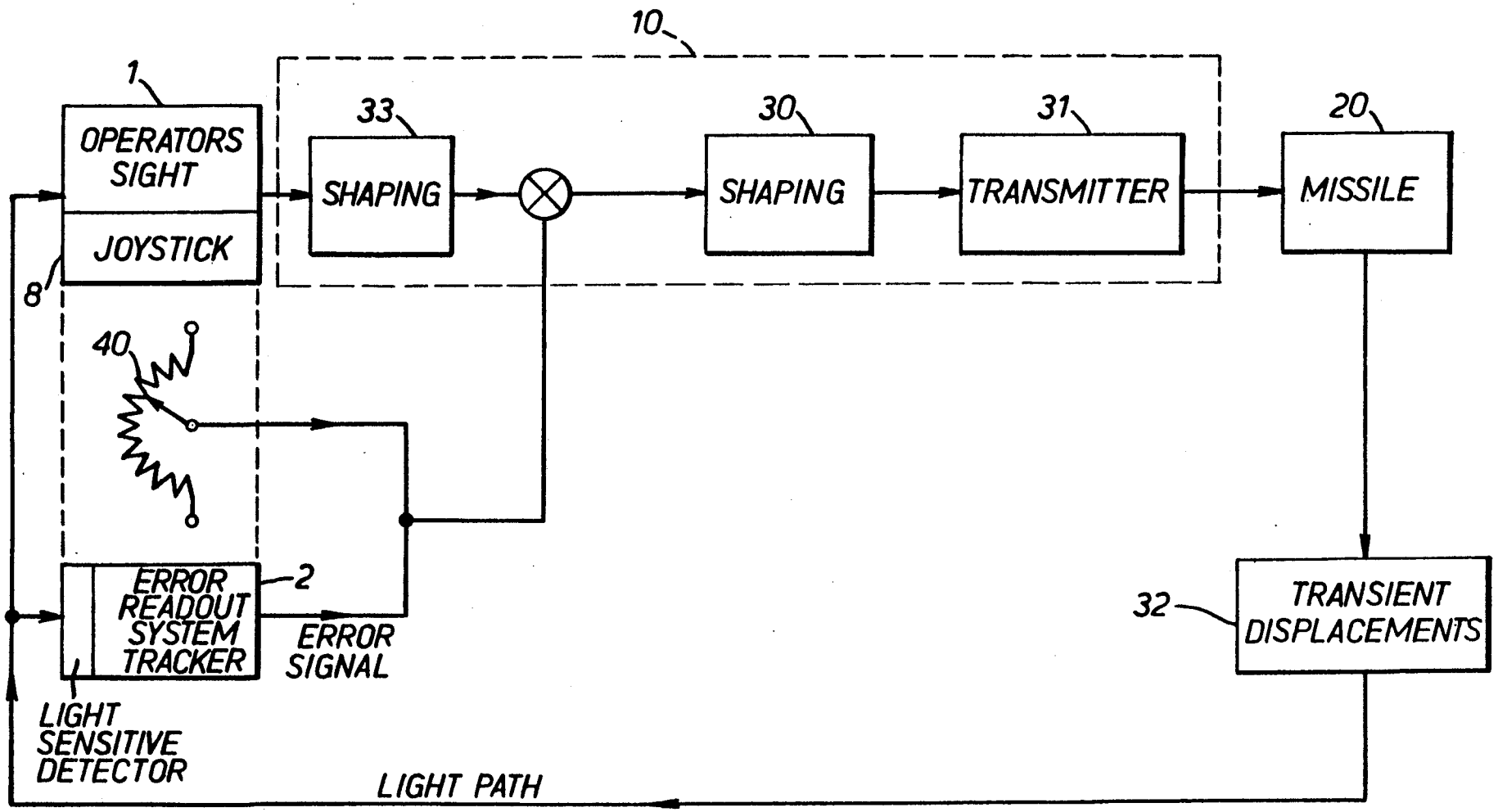
FIG. 3 is a diagram similar to FIG. 2 of a modified control system.

For aiming at a fast-moving target which is likely to pass out of the field of view of the tracker before the missile hits the target, or in the case where the sighting and tracking apparatus is mounted in an unsteady support such as a helicopter, it may be necessary to rotate the tracker during target engagement so as to keep the target in the field of view of the tracker. For this purpose a modified arrangement shown diagrammatically in FIG. 3 is used. Angular movement of the sighting telescope and tracker is detected by a pick-off 40 which supplies an appropriate compensatory signal to the shaper 30, so that tracker movement does not affect the secondary control signals transmitted to the missile. Prior to the launch of a missile the sight and tracker are aimed towards the target and the pick-off 40 is set to a zero output setting. On launch of the missile, the tracker 2 gathers the missile and controls its flight towards the target. As the target nears the edge of the field of view of the tracker, the operator turns the sight and tracker through the angle necessary to maintain the target in the field of view of the tracker, causing the tracker to produce a signal representative of the angle moved through. Simultaneously the pick-off 40 produces a signal of opposite voltage to cancel out that produced by the rotation of the tracker.

What I claim as my invention and desire to secure by Letters Patent is:

1. A guidance system for controlling the flight of a guided missile, which comprises an optical sight for aiming at a target, a manually-operable control for generating primary control signals in response to manipulation thereof by an operator, means for transmitting the primary control signals to a receiver in a missile to guide the missile in flight in accordance with the operator's manipulation of the manually-operable control, a tracker approximately aligned with the sight for tracking the missile in flight in the field of view of the tracker being constructed and arranged to measure the displacement of the missile from the tracker axis and to generate secondary caontrol signals representatve of the said displacement, and means for transmitting the secondary control signals to a receiver in the missile for guiding the missile to reduce such displacement, said manually-operable control providing control signals independently of the orientation of the optical sight and the tracker, and independently of the operation of the tracker; the tracker being operable to initially gather the missile prior to initiation of manual control of said manually-operable control whereby the missile is controlled in flight by the combined primary and secondary control signals.

2. A guidance system as claimed in claim 1 in which the sight and the tracker are mounted in approximate alignment on a common support on which the manually-operable control is also mounted, and in which the output signals of the tracker and the manually-operable control are fed to a separate control unit incorporating a transmitter for transmitting the combined signals to a missile in flight.

3. A guidance system as claimed in claim 2 in which the tracker and the sight are pivotally mounted on the common support for rotation together in approximate alignment as the sight is aimed at a moving target, and in which the tracker is provided with an electrical pick-off device constructed and arranged to produce an electrical output signal dependent on the angle of rotation of the tracker from a datum position, and means for feeding the pick-off output signal to the transmitter in opposition to the component of the tracker output signal produced by the said rotation of the tracker, the magnitude of the pick-off output signal being such as to cancel the said component.

* * * * *

UNITED STATES PATENT AND TRADEMARK OFFICE

CERTIFICATE OF CORRECTION

PATENT NO. : 5,102,064

DATED : April 7, 1992

INVENTOR(S) : DALY, Martin A. K.

It is certified that error appears in the above-identified patent and that said Letters Patent is hereby corrected as shown below:

TITLE PAGE

[30] Foreign Application Priority Data
Nov. 13, 1969 [GB] United Kingdom ..... 55721/69

Signed and Sealed this

Twenty-fourth Day of August, 1993

Bruce Lehman

*Attest:*

BRUCE LEHMAN

*Attesting Officer*

*Commissioner of Patents and Trademarks*